United States Patent [19]

Imatt

[11] 4,270,754

[45] Jun. 2, 1981

[54] AMUSEMENT DEVICE

[75] Inventor: Alex Imatt, Chicago, Ill.

[73] Assignee: Marvin Glass & Associates, Chicago, Ill.

[21] Appl. No.: 41,615

[22] Filed: May 23, 1979

Related U.S. Application Data

[63] Continuation of Ser. No. 855,352, Nov. 28, 1977, abandoned.

[51] Int. Cl.[3] ..... A63F 3/00

[52] U.S. Cl. ..... 273/273; 273/281

[58] Field of Search ..... 35/9 B, 9 C, 9 D, 27, 35/28, 74; 40/113, 115, 495; 235/88 R, 88 M, 88 G; 273/153 J, 157 R, 273, 281, 284, 272

[56] References Cited

U.S. PATENT DOCUMENTS

| | | | |
|---|---|---|---|
| 557,895 | 4/1896 | Saunders | 273/157 R |
| 804,646 | 11/1905 | Young | 235/88 M |
| 903,192 | 11/1908 | Hunt | 40/113 |
| 1,367,053 | 2/1921 | Jones | 40/113 |
| 1,492,601 | 5/1924 | Leibowitz | 40/115 |
| 1,727,629 | 9/1929 | Bing | 40/495 |
| 3,195,896 | 7/1965 | Markham | 273/273 |
| 3,347,549 | 10/1967 | Jackson | 273/273 |
| 3,625,514 | 12/1971 | Haaland | 273/153 J X |
| 3,677,548 | 7/1972 | Hincz | 273/273 |
| 3,857,569 | 12/1974 | Goldfarb | 273/273 X |

FOREIGN PATENT DOCUMENTS 1251431 12/1960 France .

*Primary Examiner*—Harland S. Skogquist
*Attorney, Agent, or Firm*—Mason, Kolehmainen, Rathburn & Wyss

[57] ABSTRACT

An amusement device useful in spelling education includes a base structure having an upper playing board with a plurality of openings arranged in a matrix of rows and columns. A removable plug is provided for each of the openings and each plug is shaped to seat within an opening and includes a handle to facilitate manual withdrawal and replacement of the plug. A disk is mounted for rotation under the playing board with an upper surface viewable through the matrix of openings when the plugs are withdrawn. The upper surface of the disk is provided with a plurality of matrices rows and columns of alphabetic characters, and each matrix is positioned to align the characters below the openings in the playing board for viewing when the disk is indexed into any of several rotative indexing positions.

10 Claims, 3 Drawing Figures

AMUSEMENT DEVICE

This is a continuation of application Ser. No. 855,352 filed Nov. 28th, 1977 now abandoned.

BACKGROUND OF THE INVENTION

1. Field of the Invention

The present invention relates to a new and improved amusement device which is especially adapted for use in spelling education. The device offers amusement and in addition, provides spelling education as well as memory training for adults and children alike. Games played with the device provide an interesting pastime which requires mental activity and which activity is stimulated by competition between the players.

2. Description of the Prior Art

In the past, many different types of amusement and game devices have been used to aid in spelling education. In addition, a variety of play objects such as blocks, game boards, etc. have been provided with letters and numbers thereon so that, for example, blocks may be aligned in a row to spell a word. Other "Dominoe" type spelling games have been developed for amusement and spelling education, and these games often provide spelling competition between players.

The present invention relates to a new and improved amusement device for use in spelling education and memory development. More particularly, it is an object of the present invention to provide a new and improved amusement device of the character described for the above purposes.

Another object of the present invention is to provide a new and improved amusement device for use in spelling education which provides an interesting and competitive game for use by two or more players.

Still another object of the present invention is to provide a new and improved amusement device of the character described which is compact in size, neat in appearance, light in weight, economical to make, easy to use and relatively low in cost.

Still another object of the present invention is to provide a new and improved amusement device of the character described which is usable by adults and children for playing a competitive game which stimulates spelling education and provides memory training.

Another object of the present invention is to provide a new and improved amusement device of the character described which includes a single element providing a plurality of different spelling education programs.

Yet another object of the present invention is to provide a new and improved amusement device of the character described having an indexable disk with a plurality of alphabetic characters formed in a plurality of matrices of rows and columns which are visible through a matrix of window openings in a board.

Another object of the present invention is to provide a new and improved amusement device of the character described wherein the indexable, rotary disks are provided with sets of alphabetic characters in matrices on opposite sides and are reversible so that an even greater number of spelling programs are available with a single disk.

Still another object of the present invention is to provide a new and improved amusement device adapted for use in a competitive game wherein spelling education and memory training are involved.

Another object of the present invention is to provide an amusement device of the character described wherein a plurality of disks, each having a plurality of matrices of alphabetic characters on opposite sides thereof are supported in a base member for selective application and use in playing the game.

SUMMARY OF THE INVENTION

The foregoing and other objects and advantages of the present invention are accomplished in an illustrated embodiment of an amusement device which includes a base structure having an upper playing board formed with a plurality of windows or openings therein arranged in a matrix pattern in rows and colums. A removable plug is provided for selectively covering each of said openings and each plug is shaped to seat within an opening and includes a handle means for facilitating the manual withdrawal and replacement of the plug. One or more rotary disks is mounted for rotation under the playing board surface of the base and the upper surface of the disk is viewable through the openings in the board when the plugs are removed. Each disk has opposite sides provided with a plurality of alphabetic characters arranged in a plurality of separate matrices. Each of the alphabetic character matrices is dimensioned so that the characters will properly align for viewing through the openings when the disk is indexed in one of several relative rotative positions on the base. The base is formed with a pocket adapted to hold a plurality of such disks so that a wide variety of spelling programs are available.

During play, a first player lifts any two plugs and exposes two letters viewable through the openings in the board. The plugs are then replaced in the original position and a second player lifts any two plugs, also exposing two letters before replacing them in their original position. The second player may then try to spell a word using at least three of the exposed and recovered letters by lifting the plugs from their openings in a correct spelling order or sequence. If a word is correctly spelled, the plugs are permanently removed from the game and are retained by the players as tokens of score. Once the plugs are removed from the board, the letters exposed are dead for the remainder of the game and the play continues in this manner until all of the plugs are removed or until both players agree that there is no word which can be spelled out of the remaining covered letters on the matrix of the disk that is in play. At the end of the game, the player having the highest number of plugs wins and a new game may then be initiated by first replacing the plugs to cover all of the openings in the board and then indexing the disk to expose a different matrix of alphabetic characters through the openings in the board when the plugs are removed.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
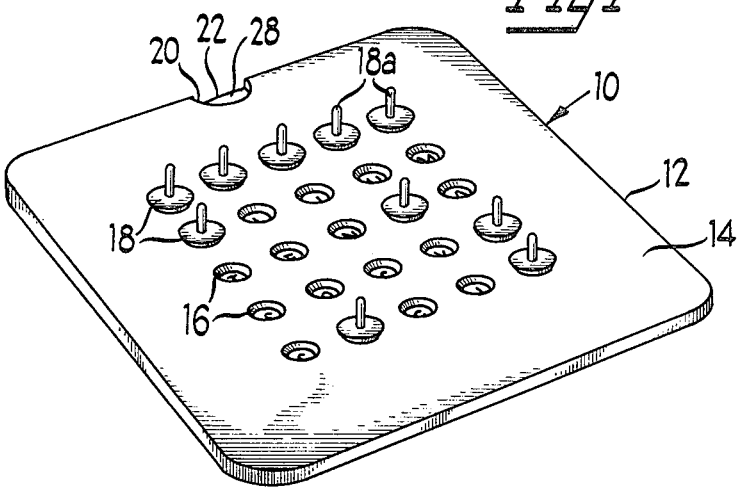
FIG. 1 is a perspective view of a new and improved amusement device constructed in accordance with the features of the present invention and shown as the device is used in playing the spelling educational game.

Referring now more particularly to the drawings, therein is illustrated a new and improved amusement device referred to generally by the reference numeral 10 and constructed in accordance with the features of the present invention.

Figure 2:
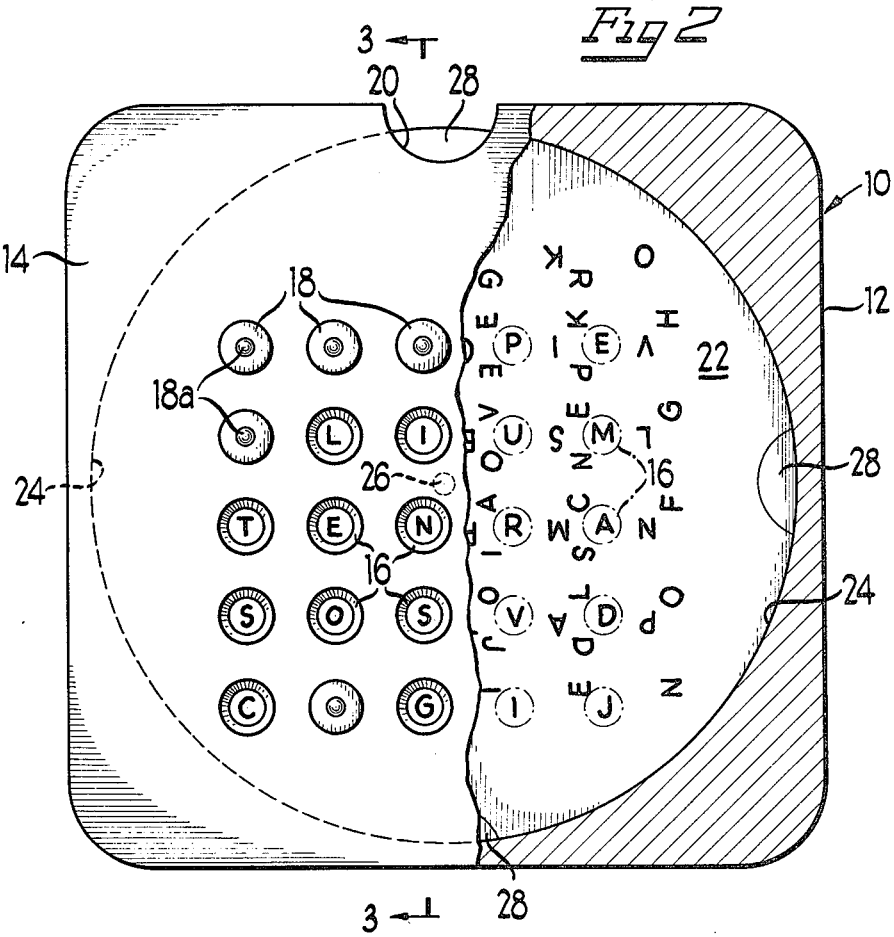
FIG. 2 is a top plan view of the device with a portion cut away showing internal components thereof.

The amusement device includes a relatively thin flat base structure 12 rounded at the corners and of square or generally rectangular shape. The base is preferably formed of molded plastic material and includes a flat upper playing surface 14 having a plurality of frustroconical openings or windows 16 defined therein. The windows are arranged in a matrix pattern in spaced apart rows and columns as shown in FIGS. 1 and 2. The spacing distance between the rows and columns is equal and the matrix as a whole, occupies a substantial portion of the upper playing surface 14.

Figure 3:
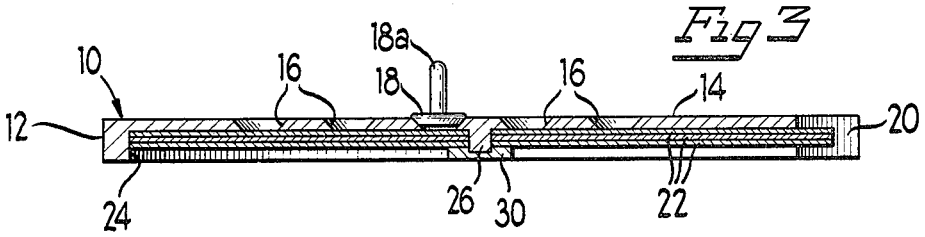
FIG. 3 is a transverse cross-sectional view of the device taken substantially along lines 3—3 of FIG. 2.

In accordance with the invention, for each of the windows 16 there is provided a removable plug 18 having a circular, frustroconically shaped lower end or base adapted to fit and seat within a window and each plug includes an upwardly extending handle 18*a* suitable for grasping between the fingers when the plugs are removed or replaced in the windows. Along one edge, the base structure 12 is formed with a semicircular shaped cut out or recess 20 for exposing a peripheral edge portion of the upper one of a plurality of thin flat circular disks 22 which are mounted in a cylindrical recess 24 formed on the under section of the base as shown in FIG. 3. The disks are centered for rotation on a downwardly depending mounting pin or axle 26 as shown in the drawings. The upper surface of the uppermost disk 22 is visible through any of the windows 16 from which the plugs 18 have been removed. At equilaterally spaced intervals around the circumference of each disk, there is provided a color coding or other suitable indexing indicia 28 which is used for aligning and indexing the disks in any one of several relatively rotative positions within the pocket 24. When any one of the indicia 28 on a disk is visible in the cut out or edge slot 20 of the base structure the disk is properly indexed for play.

On the upper and lower opposite faces of each of the disks 22 there are provided a plurality of matrices of alphabetic characters or letters. The letters in each matrix are patterned with appropriate spacing so that they appear directly centered beneath the windows 16 in the base whenever a corresponding index mark 28 is aligned in the recess 24 of the base structure. The angular or rotative spacing between the respective matrices on each disk face is selected in accordance with the total number of matrices on each face and the number of index marks 28 corresponding thereto. The inside diameter of the windows or openings 16 is selected so that only the letters of one matrix at a time are viewable through the openings and the letters of all of the other matrices on the disk are hidden from view. In the illustrated embodiment, each disk is provided with four different matrices and the letters in each matrices are differently positioned so that a variety of spelling programs are available on each disk face. In addition, because a set of disks are provided, an even greater number of spelling programs are available for use when a spelling game is played with the device 10. As illustrated, a total of three different disks are provided and each disk has four different matrices of alphabetic characters on each face so that in all, a total of 24 different spelling programs are available.

A cap 30 is adapted to seat on the lower end portion of the axle pin 26 to hold the disks in place and this cap may be removed to interchange the order of the disks and move a new disk's surface into place just beneath the underside of the upper surface of the board. In utilizing the amusement device 10 for a competitive spelling game, a randomly selected disk is positioned in the top position in the stack of disks mounted on the pin 26 in the recess 24. The top disk is rotated until one of the color coded indexing indicia 28 is visible in the recess 20 in the edge of the base structure 12. Previously, all of the plugs 18 have been placed in position to cover the windows or apertures 16 in the playing surface. A first player then withdraws any two of the plugs from their windows and thus exposes the letters to both players. After this exposure is made, the plugs are returned to their original position and a second player then withdraws any two plugs 18 from their windows 16, and after exposure, these plugs are replaced. The second player then may attempt to spell a word by remembering the positions of the exposed letters in the matrix and removing the plugs one at a time in proper spelling order. If a word is correctly spelled, the player keeps the plugs that have been removed and these are used for tokens for keeping his score. The letters on the disk that are thus exposed are then dead for the remaining portion of the game. The players take turns in sequence by removing any two plugs and replacing them in the windows after exposure. On all subsequent plays, after the player lifts two plugs from their windows and then returns them to close the windows, he has a choice to try to spell a word or he can pass without trying to spell a word. Play continues in this manner until all of the plugs 18 have been removed from the board or until both players agree that there is no word which can be spelled from the remaining "live" letters in the matrix. At this point, the player having the most plugs in his possession wins the game and a new game may then be started by again replacing all of the plugs in covering positions in the windows 16 and re-indexing the disk 22 to align a new matrix into playing position.

From the foregoing it will be seen that the amusement device provides an exciting competitive game between players and increases spelling skills and is useful in developing memory on the part of the players during the game.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An amusement device in the form of a spelling education game comprising:

a base having a playing board with a cylindrical recess on the underside thereof and a plurality of tapered openings on the top arranged in an orthogonal matrix of parallel rows and parallel columns normal to said rows;

a manually removable plug for covering each of said openings, each plug having a tapered base portion shaped to seat within an opening and including handle means to facilitate manual withdrawal and reseating in said opening;

means defining an axis of rotation offset from the center of the rows and columns of said matrix; and a disc mounted for rotation on said axis relative to said base having an upper surface viewable through said openings when said plugs are withdrawn, said upper surface having a plurality of generally smaller orthogonal matrices thereon comprising indicia arranged in parallel rows and parallel columns normal to said rows, the indicia of each matrix including four characters oriented with one character in each of four orthogonal directions, each of said matrices positioned by said axis to align the indicia thereof below said matrix of openings when said disc is in one of several rotative indexing positions relative to said base and each character appearing alone in an upright orientation when viewed through an opening of said base in one of said indexed positions when the associated plug is removed.

2. The amusement device of claim 1 including means for aligning said disc in each of said indexing positions.

3. The amusement device of claim 2 wherein said alignment means includes an edge recess in said base exposing a portion of the periphery of said disc, and indicia on said disc at spaced intervals on said periphery viewable in said recess when said disc is in an indexing position.

4. The amusement set of claim 1 wherein said openings in said playing board of said base are frusto-conical in shape and wherein said plugs include a frusto-conical lower portion with said handle means extending upwardly thereof.

5. The amusement set of claim 1 wherein said indicia on said disc are alphabetic characters for use in spelling words when said plugs are sequentially removed from said openings to expose said indicia in a selected order.

6. The amusement set of claim 5 including pivotal movement about a central axis of said base.

7. The amusement set of claim 6 wherein said disc includes an opposite surface viewable through said openings when said disc is mounted with said opposite surface facing upwardly on said pivotal mounting means, said opposite surface including a plurality of matrices thereon comprising indicia arranged in rows and columns, each of said matrices positioned to align the indicia thereof below said matrix of openings when said disc is in one of several rotative indexing positions relative to said base.

8. The amusement device of claim 1 wherein said base includes an integrally formed depending pin to define the axis of rotation of the discs.

9. The amusement device of claim 5 wherein said discs are circular and are formed with a center aperture, and the means defining an axis of rotation is defined by said pin for removably mounting a plurality of discs and supporting said discs for rotation thereon for changing the character of each matrix aligned with the openings.

10. The amusement device of claim 11 wherein said indicia in each matrix on said disc are spaced from the indicia in other matrices thereon and wherein said openings are dimensioned to preclude the viewing of indicia in other matrices when said disc is indexed in position with said one matrix aligned for viewing.

* * * * *